US005149021A

United States Patent [19]

Prouty

[11] Patent Number: 5,149,021

[45] Date of Patent: Sep. 22, 1992

[54] KITE WITH IMPROVED TAILPIECE CONNECTOR

[76] Inventor: Jonathan J. Prouty, P.O. Box 3065, Boulder, Colo. 80307

[21] Appl. No.: 549,163

[22] Filed: Jul. 6, 1990

Related U.S. Application Data

[60] Division of Ser. No. 319,681, Mar. 7, 1989, and a continuation-in-part of Ser. No. 463,021, Jan. 10, 1990, and a continuation-in-part of Ser. No. 508,358, Apr. 9, 1990, abandoned.

[51] Int. Cl.[5] ..... B64C 31/06

[52] U.S. Cl. ..... 244/155 A; 244/153 R; 244/155 R

[58] Field of Search ..... 244/155 A, 153 R, 155 R

[56] References Cited

U.S. PATENT DOCUMENTS 4,736,914 4/1988 Tabor ..... 244/155 A X

FOREIGN PATENT DOCUMENTS 2116424 4/1971 Fed. Rep. of Germany .

*Primary Examiner*—Mark Hellner

*Attorney, Agent, or Firm*—Beveridge, DeGrandi & Weilacher

[57] ABSTRACT

A kite tailpiece connector includes a piece of flexible sheet material forming a pocket for receiving the rear end of the keel strut and also forming a transverse sleeve for receiving the kite's cross strut. The cross strut includes a connector member and cross strut elements. The connector member is located in the transverse sleeve, and it connects the cross strut members together. Replaceable spacer member on the connector member determine the overall length of the cross strut, and thus determine the draft of the kite.

18 Claims, 4 Drawing Sheets

KITE WITH IMPROVED TAILPIECE CONNECTOR

REFERENCE TO RELATED APPLICATIONS

This is a continuation-in-part of U.S. patent applications Ser. Nos. 07/319,681 pending, filed Mar. 7, 1989; 07/463,021 filed Jan. 10, 1990 pending; and, 07/508,358 filed Apr. 9, 1990 now abandoned.

BACKGROUND OF THE INVENTION

This invention relates to a kite, preferably a dual string stunt kite, with an improved connector in the region where the rear end of a keel strut is connected to a bridle string and/or a cross strut assembly.

Kite keel struts have previously been connected to cross struts by means of T-shaped connectors. The present invention presents a simple and effective substitute for such an arrangement, which is effective in the ways it connects to the cross strut assembly and to the bridle strings.

SUMMARY OF THE INVENTION

This invention pertains generally to a known type of kite having a sail, a keel strut, and tailpiece connector means attached to the sail for receiving the rear end of the keel strut. According to one principal feature of the invention, a tailpiece connector includes a piece of sheet material which forms a pocket and a transverse sleeve. The pocket receives the rear end of the keel strut, and the sleeve receives the cross strut of the kite.

Preferably, the piece of sheet material extends aft beyond the transverse sleeve, bridle strings are looped around the piece of sheet material, and the keel strut extends aft of the cross strut and the transverse sleeve. The transverse sleeve is aligned with the trailing edge of the sail of the kite.

It is also preferred to form the cross strut of two strut elements connected together by a connector which is positioned in the transverse sleeve of sheet material. The connector can be provided with spacers means which abut the strut elements at their inboard ends to vary the overall length of the cross strut and thus affect the draft of the kite. Retainer means may be provided to keep the connector in the transverse sleeve and, in one embodiment, this retainer means also serves as the spacer means.

The retainer means may be a resilient tube which extends perpendicularly through the transverse sleeve and through the connector to provide a shock absorbing separator between the strut elements. In another embodiment the retainer means is two retainer members which are externally mounted on the connector on opposite edges of the sheet material to prevent the connector from sliding from the transverse sleeve. In this latter embodiment, the ends of the connector are inserted into hollow cross strut elements, so the external retainer members also serve as spacers which affect the overall length of the cross strut.

In a device where the connector has a bore which receives the strut elements, the spacer may be a removable plug located in the bore to limit the distance the strut elements extend into the bore.

According to another principal feature of the invention, at least one bridle string is attached to the tailpiece connector in a fashion whereby the end of the bridle string is looped transversely around the sheet and passes forwardly from the sheet for attachment to a control string.

DETAILED DESCRIPTION

Figure 1:
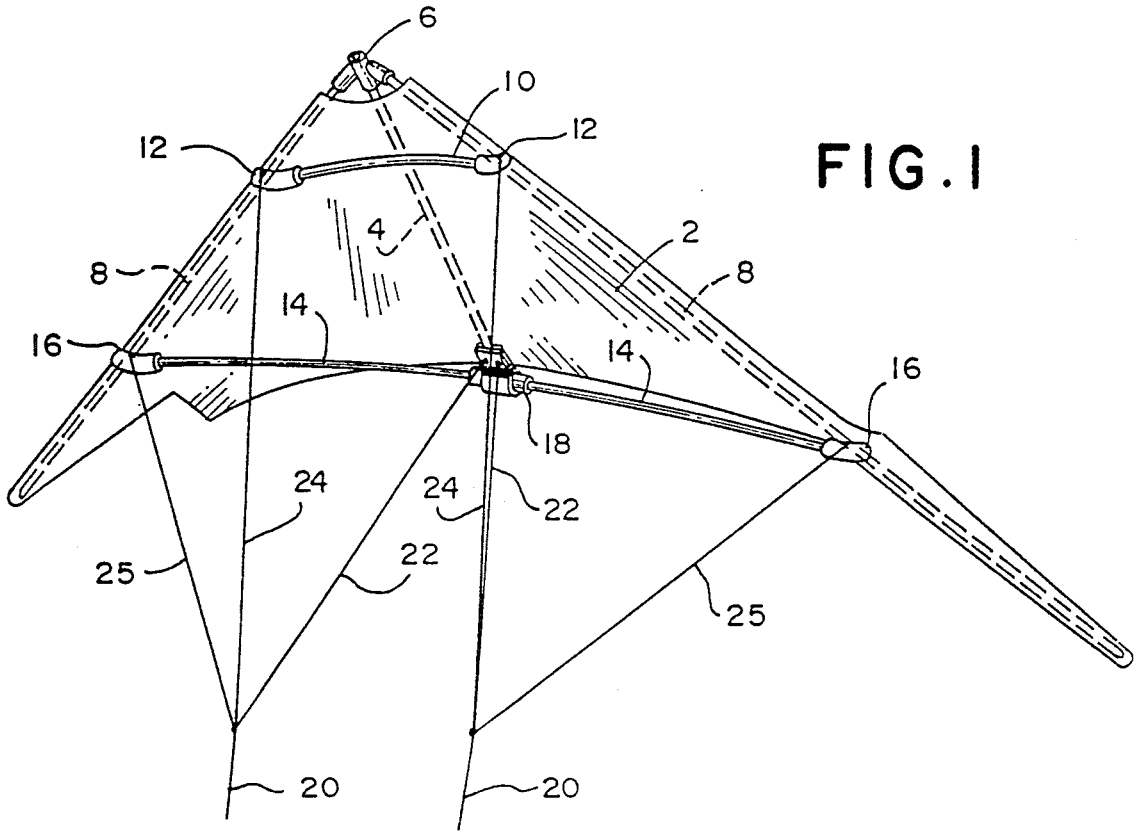
FIG. 1 is a perspective view of a dual string stunt kite constructed according to the invention.

As shown in FIG. 1, the kite according to the invention has a sail 2 with a central longitudinal sleeve which receives a keel strut 4. A nose connector 6, preferably of the type shown in U.S. Pat. No. 4,286,762, connects the forward end of the keel strut 4 to two rearwardly diverging wing struts 8 which stiffen the leading edges of the sail. A forward cross strut 10 is connected to the wing struts 8 by connectors 12. Preferably, each of these connectors is a piece of vinyl tubing having a longitudinal bore which receives an outboard end of the strut 10, and a transverse bore which receives a wing strut 8, as is well-known in the art.

The rear cross strut is formed of two separate cross strut members 14 which have their outboard ends connected to the wing struts by tubing connectors 16 similar to the forward connectors 12. The inboard ends of the members 14 are connected to the tailpiece connector 18 which is described in greater detail later in this specification in connection with FIG. 2.

The kite is flown by two control strings 20 which are connected to a pair of bridle assemblies. Each bridle assembly includes three bridle strings. The first bridle string 22 extends forwardly from the tailpiece connector 18, the second bridle string 24 extends forwardly from the forward connectors 12, and the third bridle string 25 extends forwardly from the rear connector 16. The forward ends of these three bridle strings are connected together and to the respective control strings 20 as shown in FIG. 1.

Figure 2:
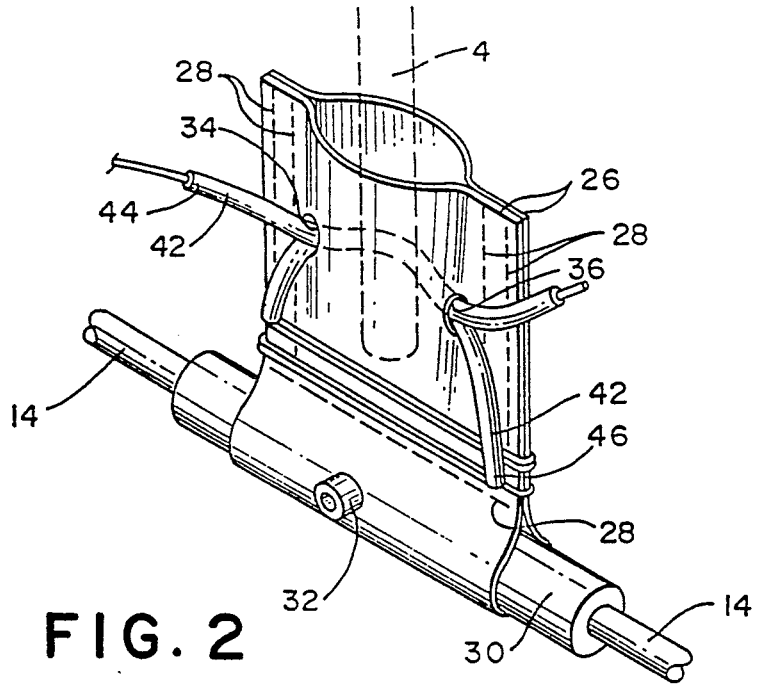
FIG. 2 is an enlarged perspective view of the tailpiece connector used in the kite of FIG. 1.
Figure 3:
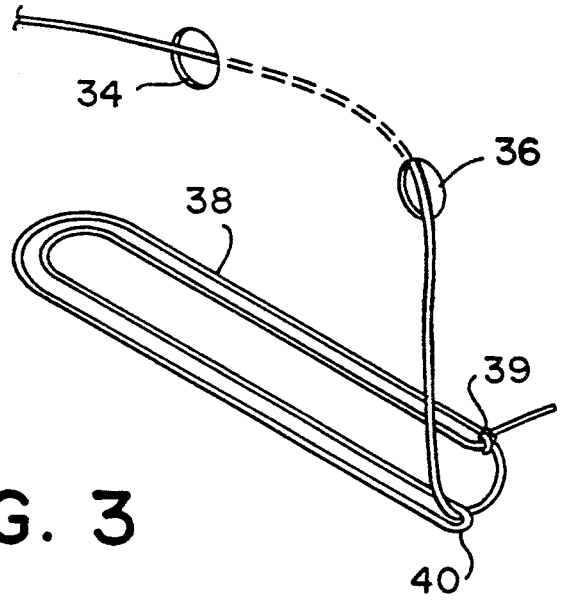
FIG. 3 is a diagrammatic view showing the manner in which the bridle string is connected to the tailpiece connector.

The details of a tailpiece connector 16 are shown in FIGS. 2 and 3. It includes a piece 26 of sheet material which is folded upon itself as shown in FIG. 2 so that its opposite ends overlie the opposite surfaces of the sail 2 and are sewn thereto by lines of stitching 28. The tailpiece connector forms a longitudinal pocket and a transverse sleeve. The longitudinal pocket receives the rear end of the keel strut 4, and the transverse sleeve receives the cross strut which includes a cross tube 30 which connects the two cross strut elements 14. The tube 30 is preferably formed of flexible vinyl so it will hingedly interconnect the rear cross strut elements 14.

To assist in proper positioning of the members 14 in the tailpiece connector and to provide a shock absorbing separator, a resilient bumper tube 32 extends perpendicularly through the cross tube 30.

A pair of holes 34, 36 are provided in the material 26 on opposite sides of the keel-receiving pocket. The two bridle strings are transversely looped aroung the material 26 and, from this area, each bridle string extends to one of the holes 34 or 36, rearwardly through the hole, around the rear of the keel strut, and then forwardly through the opposite hole. From this point, the bridle string extends to the control string as shown in FIG. 1.

Details of a suitable bridle string connection are shown diagrammatically in FIG. 3 where it will be seen that the string is knotted at 39 to form a loop 38 which is folded upon itself, halfway along its length, so that the loop lies on both sides of the tailpiece connector. From the knot 39, the bridle string extends through the tip 40 of the loop, forward to the hole 34, in through the hole 34, around the material 26 behind the keel strut, and out through the hole 36 to the position where the bridle strings are connected together to complete the bridle assembly. While only one such bridle string is shown in FIG. 3, it will be understood that there are two such bridle strings which are mirror images of each other.

To protect the bridle string from abrasion and to prevent the tip 40 of the bridle string loop from slipping toward the hole 34, the bridle string has a flexible sheath 42 which, as shown in FIG. 2, has a forward end 44 and a rear end 46. Preferably, this sheath is a short length of vinyl tubing which is slipped over the string.

Figure 4:
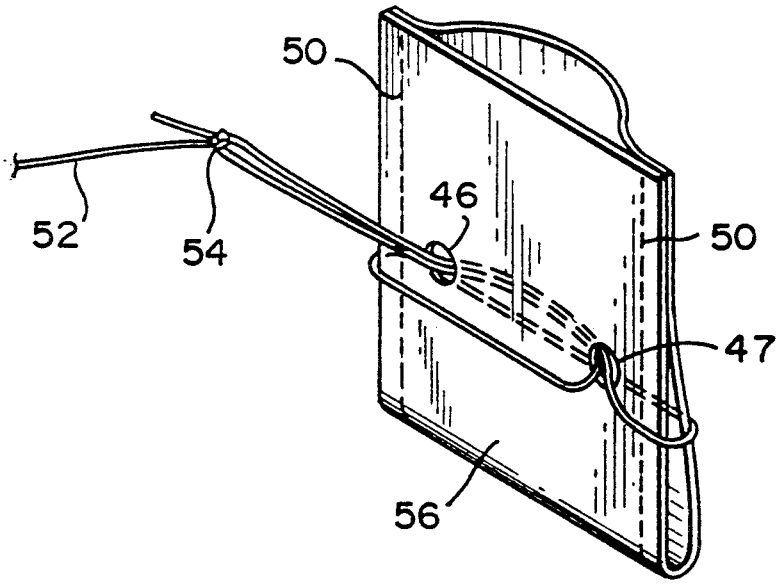
FIG. 4 is a perspective view of a second embodiment of the invention, including a diagrammatic illustration of only one bridle string.

An alternative bridle connection, shown in FIG. 4, is suitable for various situations including those in which a cross strut is not connected to the tailpiece. In this embodiment, the tailpiece connector has holes 46 and 47 that are approximately at the trailing edge of the sail. The front panel of the tailpiece connector is generally flat, and the rear panel is held in a bowed condition by lines of stitching 50. A bridle string 52 is knotted at 54 to form a loop. This loop encircles the trailing end portion 56 of the tailpiece connector, goes in the hole 47, passes behind the keel strut pocket, and comes out the hole 46. A mirror image of this bridle string, omitted from the drawings for purposes of clarity, goes into hole 46 and comes out of hole 47.

Figure 5:
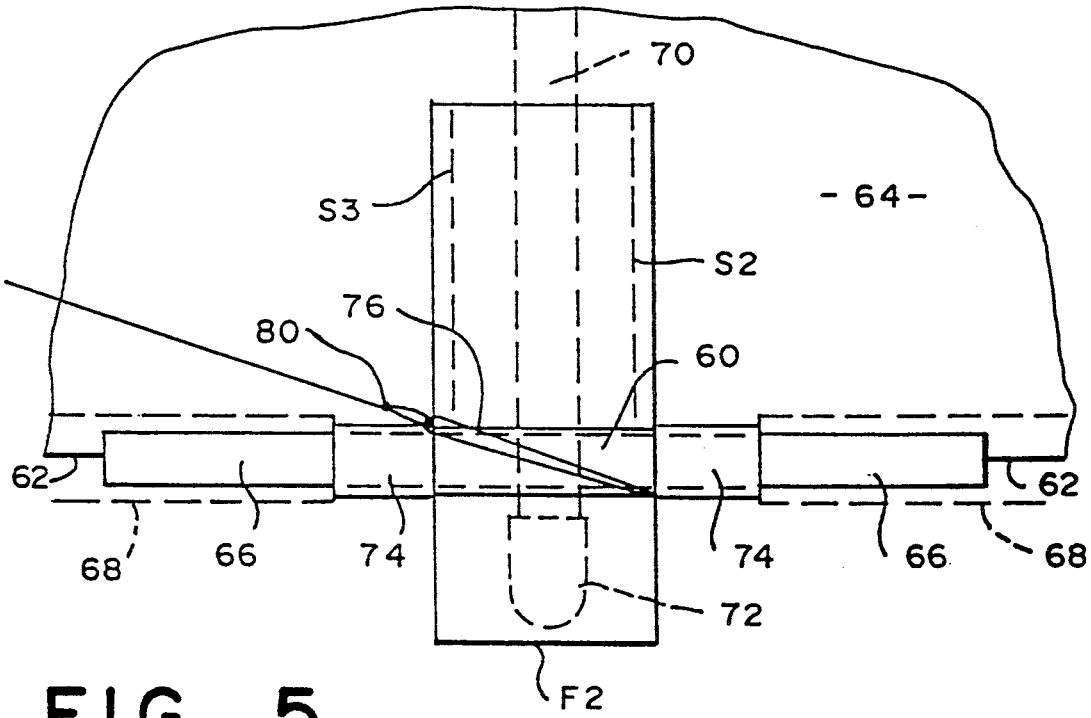
FIG. 5 is a front view of a kite tailpiece constructed according to another embodiment of the invention.

In the embodiment of FIG. 5, the fabric portion of the tailpiece connector is formed of sheet material such as Dacron polyester fabric, folded to triple thickness and sewn so the sail at its trailing edge. In this case, the tailpiece connector includes a transverse fabric sleeve 60 which has it axis aligned with the trailing edge 62 of the sail 64 rather than lying aft thereof; and, the connector 66 of the cross strut is a transverse ferrule having ends which are inserted in the bores of hollow cross strut elements.

Figure 6:
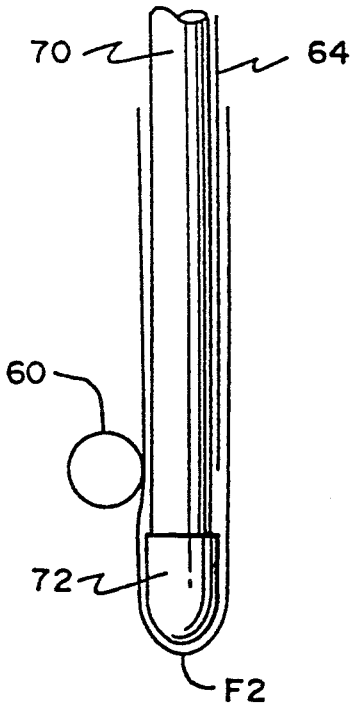
FIG. 6 is a diagrammatic side view of the embodiment of FIG. 5, with the cross strut removed therefrom.
Figure 7:
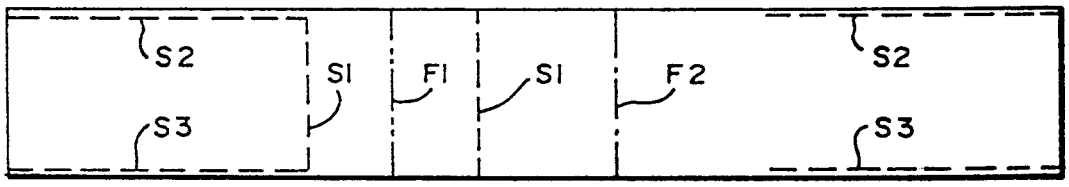
FIG. 7 is a folding diagram illustrating the manner of forming the fabric portion of the tailpiece connector shown in FIG. 5.

The fabric for the tailpiece connector is shown in FIG. 7 which previously has been folded twice along longitudinal fold lines so that it has three thickness. Then, this fabric is folded temporarily along line F1 so that the stitch lines S1 are aligned and are stitched together to form the transverse sleeve 60. The fabric is then laid flat and refolded upon itself at F2 to form the bottom of the keel strut pocket. The stitch lines S2 are coincident and stitch lines S3 are coincident. The folded fabric piece is positioned at the trailing edge 62 of the sail so that its panels lie against opposite surfaces of the sail 64, and the previously stitched line S1 is substantially coincident with the trailing edge 62 of the sail. Stitching is then applied along the lines S2 and S3 to attach the fabric directly to the sail. As shown in FIG. 6, the keel strut 70 is inserted in the open-sided pocket defined at the aft edge by the fold F2. The connector 66 is inserted in the transverse sleeve 60 formed by the stitch line S1. A vinyl cap 72 is provided on the aft end of the keel strut. The presence of the transverse connector 66 and the bridle strings around the tailpiece connector obstruct any excessive forward movement of the cap 72 and the keel strut 70 to which it is attached. The cap 72 also prevents the keel strut from damaging the tailpiece connector fabric.

As shown in FIGS. 5 and 6, a pair of short resilient vinyl tubing pieces 74 are slipped over the opposite ends of the connector 66 where they are frictionally or adhesively retained. These pieces serve as retainers in the respect that their outside diameter is greater than the inside diameter of the sleeve 60, so they prevent the connector 66 from slipping from the transverse sleeve.

Bridle strings are easily attached to the tailpiece connector and they are looped thereabout as shown at 76 in FIG. 5. Prior to being attached to the tailpiece connector, each bridle string is knotted at 80 to form a fixed end loop, and the bridle string is passed through this loop to provide a variable slip loop which is positioned transversely and diagonally around the fabric of the tailpiece connector, thus also being looped around the keel strut 70 and the cross strut at their intersection. In the alternative, a variable slip loop may be secured with a lark's head knot for more positive retention. Two such bridle strings are used in dual string stunt kites.

After the bridle strings are positioned, the tubular cross strut elements 68, shown in broken lines, are slipped over the opposite ends of the connector 66 where they are retained by interference fits. The inboard ends of the cross strut elements 68 abut the outboard surfaces of the pieces 74. These pieces 74 serve as resilient bumpers, and they also act as spacers which determine the overall length of the cross strut. By replacing the illustrated pieces 74 with shorter pieces, the cross strut can be shortened to increase the draft of the kite. Conversely, longer spacers will lengthen the cross strut to reduce the draft.

The device of FIGS. 5–7 may be modified by sewing only the front panel to the sail, and using the bridle strings to secure the rear panel of the tailpiece connector panel in position against the rear surface of the sail. This modification provides easy access to and removal or replacement of the keel strut by loosening the bridle strings and opening the tailpiece.

Figure 8:
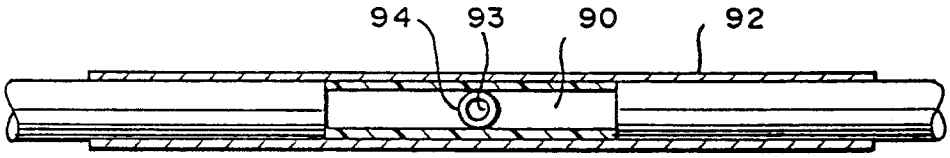
FIG. 8 is a partial sectional view of another embodiment of the invention.

Another type of draft-adjusting spacer 90 is shown in FIG. 8 where the strut elements are inserted in a rigid aluminum tubular connector 92. This spacer 90 is a tubular plug provided with a central traverse hole 93 which receives a retainer 94 which corresponds to the retainer 32 in FIG. 2. The opposite ends of the spacer 90 are abutted by the inboard ends of the cross strut members which correspond to members 14 in FIG. 2 and are inserted in the tubular connector with an interference fit. Thus, the length of the plug 90 determines the cross strut length and the kite's draft. The draft is increased when a shorter replacement plug is used, and the draft is decreased when a longer replacement plug is used.

Figure 9:
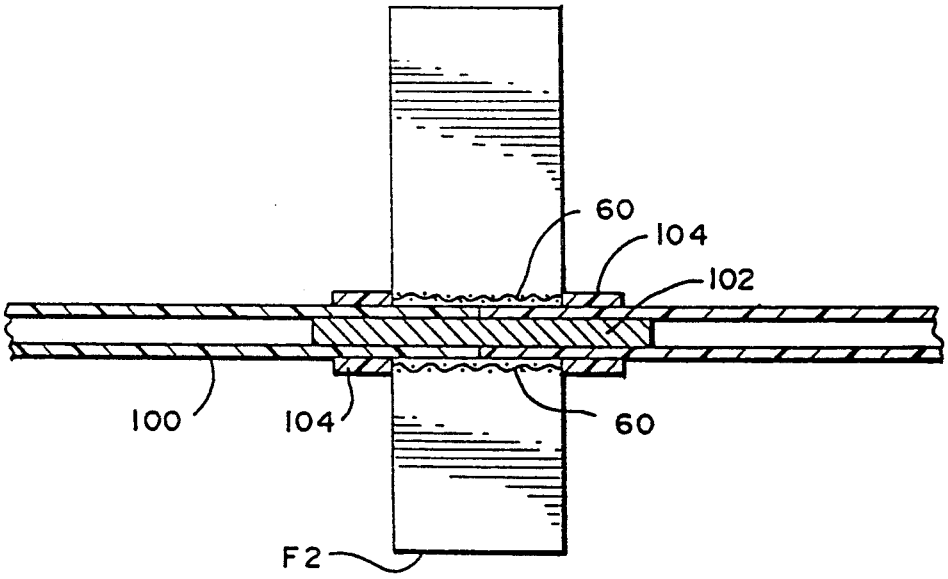
FIG. 9 is a partial sectional view of a preferred embodiment of the invention.

The preferred embodiment of the invention is shown in FIG. 9. It has the same fabric piece sewn to the sail as in the FIG. 5 embodiment, but it is inverted so the transverse sleeve 60 will be above the sail when the kite is flying overhead. With this arrangement, the bridle strings will interfere less with the task of inserting the cross strut into the sleeve 60. In the FIG. 9 embodiment, the sail, stitching and keel stick will be the same as in FIGS. 5 and 6, but they are omitted from the drawing for simplification.

In FIG. 9, the cross strut includes two tubular cross strut elements 100 connected together by an internal ferrule 102 which is received in the hollow bores of these elements. To prevent the ferrule 102 from being lost, it may be permanently attached to one strut element 100 and detachably frictionally engaged in the other strut element 100. If solid cross strut elements are used, a tubular external ferrule may be provided to connect them. In either case, the ferrule will be inside the fabric sleeve 60.

To prevent the cross strut assembly from sliding excessively in the sleeve 60, vinyl bumpers 104 are frictionally mounted on the struts 102, on opposite edges of the fabric piece. This assures bilateral symmetry, and it enhances in-flight performance by eliminating maneuver-produced differentials between the drafts of the left and right hemispheres of the sail.

A cross strut formed of two elements 62 or 102 is preferable to a unitary cross strut for several reasons. From a manufacturing standpoint, it is more cost effective because there is less waste. When the user disassembles the kite, the inboard ends of the strut elements are separated, the outboard ends remain attached permanently to the wing blocks to avoid any risk of loss, the strut elements are positioned parallel to their respective wing struts, and the kite is conveniently rolled up. A kite with the tailpiece connector of FIG. 9 can be rolled up more compactly and with less risk of sail damage than the kites of FIGS. 2, 5, and 8 because the latter have members 30, 66, and 92 which protrude laterally from the tailpiece fabric.

Persons familiar with the field of the invention will recognize that the invention may take many forms other than the preferred embodiments disclosed in this specification. Therefore, it is emphasized that the invention is not limited to the disclosed embodiments but embraces variations thereto and modifications thereof which fall within the spirit of the following claims.

I claim:

1. A kite having a sail, a keel strut having a rear end, tailpiece connector means attached directly to the sail for receiving the rear end of the keel strut, said tailpiece connector means including a piece of sheet material forming a pocket which receives the rear end of the keel strut, said piece of sheet material also forming a transverse sleeve, and a cross strut extending through said transverse sleeve.

2. A kite according to claim 1 having a bridle string looped around said piece of sheet material.

3. A kite according to claim 1 wherein said keel strut extends aft of said cross strut, and at least one bridle string is looped around said keel strut and cross strut at their intersection.

4. A kite according to claim 1 wherein the keel strut extends aft beyond the transverse sleeve.

5. A kite according to claim 1 wherein portions of the piece of sheet material extend aft beyond said transverse sleeve.

6. A kite according to claim 1 in which the sail of the kite has its trailing edge aligned with said transverse sleeve.

7. A kite according to claim 1 wherein the cross strut includes two strut elements connected together by a connector, said connector being positioned in said transverse sleeve of sheet material.

8. A kite according to claim 7 wherein said connector is provided with spacer means for abutting said strut elements at their inboard ends.

9. A kite according to claim 7 wherein each of the strut elements have bores, and the connector has opposite ends inserted in said bores.

10. A kite according to claim 7 having retainer means for keeping said cross strut in said transverse sleeve.

11. A kite according to claim 10 wherein each of the strut elements has a bore, and the connector has opposite ends inserted in said bores.

12. A kite according to claim 11 wherein the retainer means incudes two retainer members mounted externally on said cross strut on opposite edges of said piece of sheet material to prevent the cross strut from sliding in said transverse sleeve.

13. A kite according to claim 10 wherein the retainer means is a retainer member which extends perpendicularly through the connector and through the transverse sleeve.

14. A kite according to claim 13 wherein the retainer means is a resilient tube which provides a shock absorbing separator between the cross strut elements.

15. A kite according to claim 10 wherein the retainer means incudes two retainer members mounted externally on said connector on opposite edges of said piece of sheet material to prevent the connector from sliding in said transverse sleeve.

16. A kite according to claim 7 wherein the connector has a bore which receives said strut elements.

17. A kite according to claim 16 having removable spacer means located in said bore to limit the distance the strut elements extend into said bore.

18. A kite according to claim 1 wherein there are two bridle strings, said kite having wing struts for stiffening leading edges of the sail, a pair of rear wing strut connectors which connect outboard ends of the cross strut elements to the wing struts, a forward cross strut, a pair of forward wing strut connectors which connect the ends of the forward cross strut to the wing struts, and two bridle assemblies which each include (i) a first bridle string extending forwardly from the tailpiece connector means, (ii) a second bridle string extending forwardly from a said forward wing strut connector, and (iii) a third bridle string extending forwardly from a said rear wing strut connector; said strings of each said bridle assembly having their forward ends connected together.

* * * * *